United States Patent [19]

Vancil

[11] 4,195,948

[45] Apr. 1, 1980

[54] HYDRAULIC BOAT LIFT WITH REGULATING SYSTEM THEREFOR

[76] Inventor: Karl L. Vancil, 368 Angelo Ln., Cocoa Beach, Fla. 32931

[21] Appl. No.: 936,930

[22] Filed: Aug. 25, 1978

[51] Int. Cl.[2] ..... B63C 3/06

[52] U.S. Cl. ..... 405/3; 405/7; 405/221

[58] Field of Search ..... 405/3, 4, 5, 6, 7, 2, 405/1, 185, 188, 190, 196, 204, 209, 226, 221; 214/1 A, 95 R, 89, 151; 187/17; 52/148

[56] References Cited

U.S. PATENT DOCUMENTS

| | | | |
|---|---|---|---|
| 2,151,394 | 3/1939 | Rogers | 405/3 |
| 2,988,893 | 6/1961 | Borrmann et al. | 405/226 |
| 3,664,388 | 5/1972 | Frankel | 405/221 |
| 4,087,980 | 5/1978 | Kono | 405/188 |

FOREIGN PATENT DOCUMENTS

| | | | |
|---|---|---|---|
| 91003 | 5/1961 | Denmark | 405/3 |
| 1,020,546 | 2/1966 | United Kingdom | 405/3 |

*Primary Examiner*—David H. Corbin
*Attorney, Agent, or Firm*—Berman, Aisenberg & Platt

[57] ABSTRACT

An hydraulic boat lift utilizing readily available city water as the pressure fluid comprises one or more lift cylinders buried vertically under a body of water with the upper ends of the cylinders protruding into the water, a cradle supporting plate is connected to the top of each cylinder ram to support a cradle below the water surface until the cradle is elevated above the water surface, the cradle being stabilized in a horizontal plane by at least three poles vertically buried below the water and spaced equiangularly about each lift cylinder, each pole at its upper end being connected by a rigid radial member to the upper end of the lift cylinder and the cradle supporting plate being connected to the upper end of each pole by a chain having means to adjust its length to prevent the plate and cradle from being unbalanced out of horizontal position. To increase the resultant lift of the hydraulic cylinder, a single booster cylinder and a transfer cylinder for each of the lift cylinders are provided with the piston in the booster cylinder having a larger area than any of said transfer pistons and being rigidly connected to one another so as to provide equal displacements of the booster and transfer pistons and to simultaneously operate all of the lift cylinders at equal rate of displacement. Means are provided for cyclic operation of the booster cylinder to accomplish elevation of the cradle. The invention also contemplates a method of dry docking.

13 Claims, 17 Drawing Figures

HYDRAULIC BOAT LIFT WITH REGULATING SYSTEM THEREFOR

BACKGROUND OF THE INVENTION

This invention relates to an hydraulic boat lift and operating system therefor, and more particularly to a boat lift utilizing city water and pressure as its pressure fluid.

SUMMARY OF THE INVENTION

It is frequently necessary, or desirable, that a boat owner elevate his craft from the surface of the water to protect the same during inclement weather, storms and the like or to perform maintenance on the hull. Unfortunately, due to the complicated structure of conventional boat lifts, their expensiveness to fabricate and their high cost of operation, most boat owners have been unable to afford a boat lift and are thereby forced to leave their craft in the water except occasionally when taken to a boatyard and hauled out for repair.

The present invention provides a simple and inexpensive boat lift which may be easily installed in the water near a dock, or near a location in which the boat is normally anchored, so that the boat may be moved through the water on to the lift whenever desired, and the lift may be operated to elevate the boat above the surface of the water. To this end, various elements of the hydraulic system, which are normally submerged in the water, are preferably readily available items formed of non-corrosive, inexpensive, plastic materials. Each pressure fluid lift cylinder is buried in the bed of a body of water in a substantially vertical position with the top protruding into the water and the cylinder and attached cradle supporting plate are stabilized by at least three poles similarly buried and connected at their tops to the lift cylinder by rigid connecting means, flexible chains of preadjusted length being connected from each pole to the cradle supporting plate so that the plate and cradle upon elevation will not be tilted from the horizontal due to any unbalanced condition of the boat on the cradle.

The invention further contemplates, for the lifting of heavier vessels, the interpositioning of a booster cylinder between the city water system and the lift cylinders so as to increase the pressure of the water being used as pressure fluid to elevate the boat. It is very desirable in order to reduce the displacement of the booster cylinder that means be provided for automatically operating the booster cylinder through a plurality of cycles necessary to complete the elevational displacement of the lift cylinder piston and ram. This is accomplished by use of master and slave valves so arranged in the hydraulic circuit as to stop the flow of pressure fluid to the lift cylinders when the booster piston has completed its displacement and to divert the pressure fluid to operate the master and slave valves to reverse the movement of the booster piston and connected transfer pistons so that the booster piston returns to its initial state, at which time the master and slave valves return to their original positions to repeat the cycle of charge and discharge of pressure fluid to and from the booster cylinder.

In a simplified version of the invention a fixed docking frame is provided comprising spaced support posts having their lower ends buried in a water bed and their upper ends above the water level. A boat may then be sailed onto the cradle of a vertical cylinder and ram disposed between the support posts. The cylinder is operated to lift the cradle and boat to a level above the support posts. The boat is then turned 90° and lowered onto the support posts.

From the above, it will be apparant that it is a primary object of the present invention to provide an hydraulic boat lift and regulating system for operation thereof which is capable of utilizing readily available and inexpensive city water and city water pressure as the pressure fluid.

It is another important object of the invention to provide a boat lift, having the above described characteristics, which is provided with a booster cylinder to increase the pressure of its operating pressure fluid, together with means for automatically operating the booster through a number of charge/discharge cycles essential to complete the displacement and elevation of the lift cylinder ram and boat cradle.

It is a further object of the invention to provide a boat lift having the above described characteristics, which is capable of lifting and lowering a boat evenly though supported in an unbalanced condition on the lift cradle.

It is yet another object of the invention to provide an hydraulic boat lift, having the above described characteristics, which is operative with as few as one pressure fluid lift cylinder, and which, as desired or found necessary, may utilize a plurality of lift cylinders, whose operation is regulated to provide equal rates of displacement of all of the said cylinders.

Yet a further object of the invention is to provide an hydraulic boat lift, having the above described characteristics, which is formed of waterproof, non-corrosive materials and which despite submergence in water will have a long useful life with a minimum of maintenance to preserve operability.

It is still another object of the invention to provide an hydraulic boat lift, having the above described characteristics, which is formed of inexpensive and readily available items and materials, which is of simple structure and has a minimum number of parts, which is easy to fabricate and assemble, which is relatively easy to install in the water, and which is easy and inexpensive to operate.

It is a still further object of the invention to provide a method of dry docking which entails the steps of sailing a boat to a position between fixed support posts extending above the water level, lifting the boat by an hydraulic cylinder to a level above the support posts, turning the boat 90°, and lowering the boat to rest on the support posts.

While the invention will be described in a form wherein it is used as a boat lift, it will be readily apparent that its use is not thus limited, and that the invention may be readily applied to other purposes as for example, use as an hydraulic ram, a hoist, a press and like devices.

BRIEF DESCRIPTION OF THE DRAWINGS

The novel features that are considered characteristic of the invention are set forth with particularity in the appended claims. The invention, itself, however, both as to its organization and its method of operation, together with additional objects and advantages thereof, will best be understood from the following description of specific embodiments, when read in connection with the accompanying drawings, wherein like reference characters indicate like parts throughout the several figures, and in which:

DESCRIPTION OF THE PREFERRED EMBODIMENTS

Figure 1:
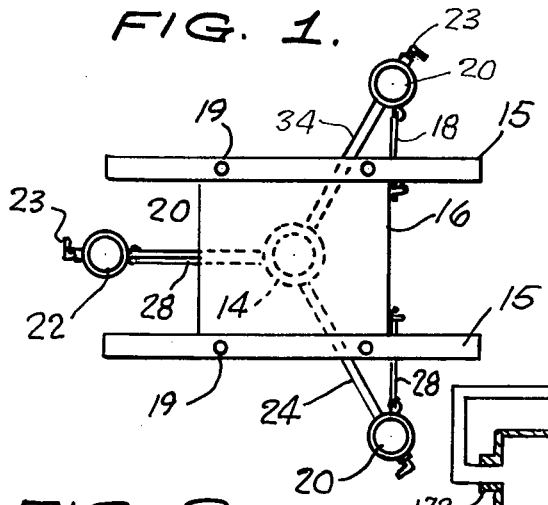
FIG. 1 is a plan view of a boat lift according to the invention utilizing a single pressure fluid cylinder as installed in a body of water.
Figure 2:
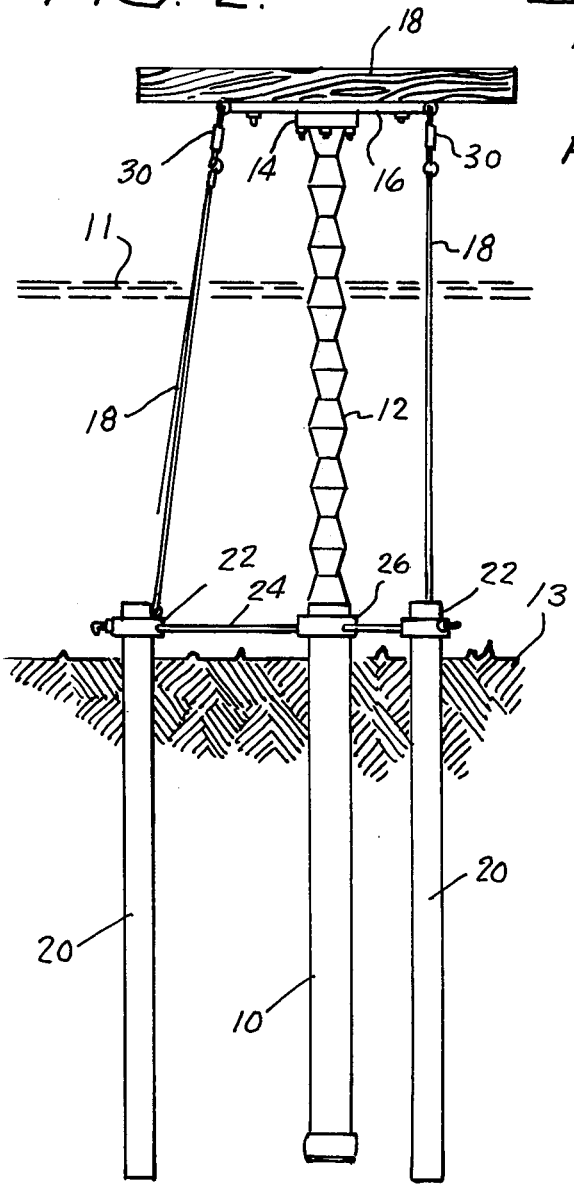
FIG. 2 is a side elevation of the embodiment illustrated in FIG. 1.
Figure 3:
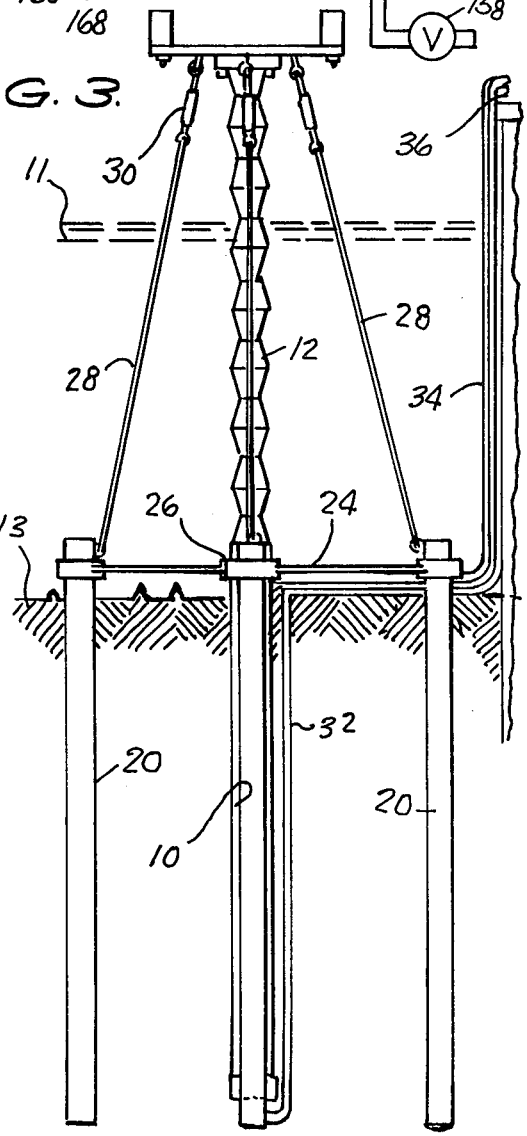
FIG. 3 is a front elevation of the boat lift of FIG. 1.

Referring now more particularly to the drawings, in FIGS. 1–3 is illustrated a boat lift involving a single pressure fluid cylinder and a supporting tripod structure suitable for elevating a small boat above the surface of the water. The pressure fluid cylinder 10 is buried under water 11 in a substantially vertical position with its upper end just above the surface of the water bed 13. The lift cylinder includes a piston and piston rod, or ram, which extends out of the top of the cylinder, and being of a length slightly longer than the cylinder is adequate, upon extension from the cylinder, to have its outer end reach above the water surface as illustrated in FIGS. 2 and 3. The ram is surrounded by a corrugated, waterproof boot, or tube, 12, which is flexible and extensible and whose lower end is secured to the top of lift cylinder 10 while its upper end is secured to a disc 14 which is bolted to a cradle supporting plate 16 forming the bottom of the boat cradle. The cradle is completed by a pair of rails 18 secured by bolts 19 to opposite side edges of plate 16.

To stabilize the boat lift, at least three poles, or piles 20, are embedded in the water bed at equi-angularly spaced locations from the pressure fluid cylinder 10, the piles 20 being placed in a circumference of a circle surrounding the fluid lift cylinder 10 as a center, and being preferably driven into the water bed in vertical directions parallel to the pressure fluid cylinder 10. The top of each pile 20 is surrounded by a collar 22 and fastened by screw 23. Each collar has a rigid, radially disposed, rod 24 connected thereto. The other ends of the rods are connected to a collar 26 secured to the top end of the pressure fluid cylinder 10. Flexible chains, or cables 28, are each secured at its bottom to the top of a pile 20 and at its top to the bottom plate 16 of the cradle. A turn buckle 30 is interposed between the cable and its connection to the plate 16. Two of the cables 28 are connected at opposite corners of one side of the plate 16, and the third cable is connected to the plate at the center of the opposite side. It is therefore apparent that when the ram of the pressure fluid cylinder is lifted to the elevated condition illustrated in FIG. 2, the turnbuckles 30 may be turned to adjust the lengths of the cable 28 so as to hold the cradle bottom 16 in a horizontal plane. Thus when a boat is lifted on cradle 16, 18 to maximum elevation, the cables 28 being adjusted to their maximum lengths will prevent tipping of the cradle bottom 16 out of the horizontal, even though the boat is in unbalanced condition on the cradle.

A pressure fluid conduit 32 is installed to lead from control apparatus, not shown, on pier 36 to an inlet port at the bottom of the lift cylinder 10, and a similar pressure fluid conduit 34 leads from a port at the top of the lift cylinder to the control apparatus.

In installing the boat lift, the cylinder 10 and the stabilizing poles 20 are pressed, or driven, into the mud bottom 13 by any suitable means, and may be sunk into openings formed with the aid of high velocity water pressure. The pressure fluid utilized in conduits 32, 34 to operate the lift cylinder is preferably water obtained from a community water system and delivered with the normal pressure available in that system. The construction of the lift cylinder and the means for increasing the available pressure to operate heavy loads will be explained more fully hereinafter.

Figure 4:
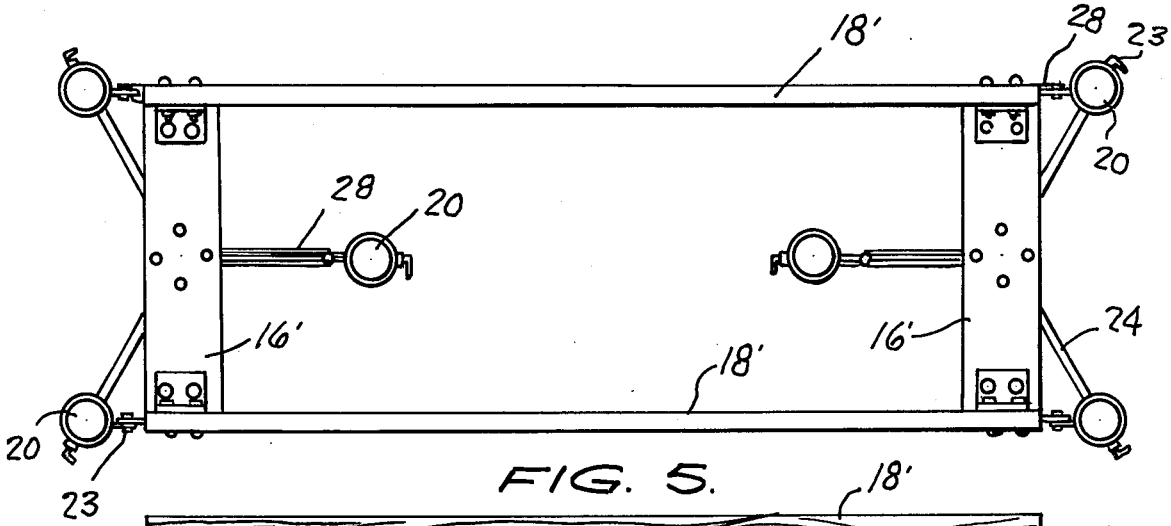
FIG. 4 is a plan view of a boat lift according to a second embodiment of the invention which employs a pair of pressure fluid cylinders and which is installed under water.
Figure 5:
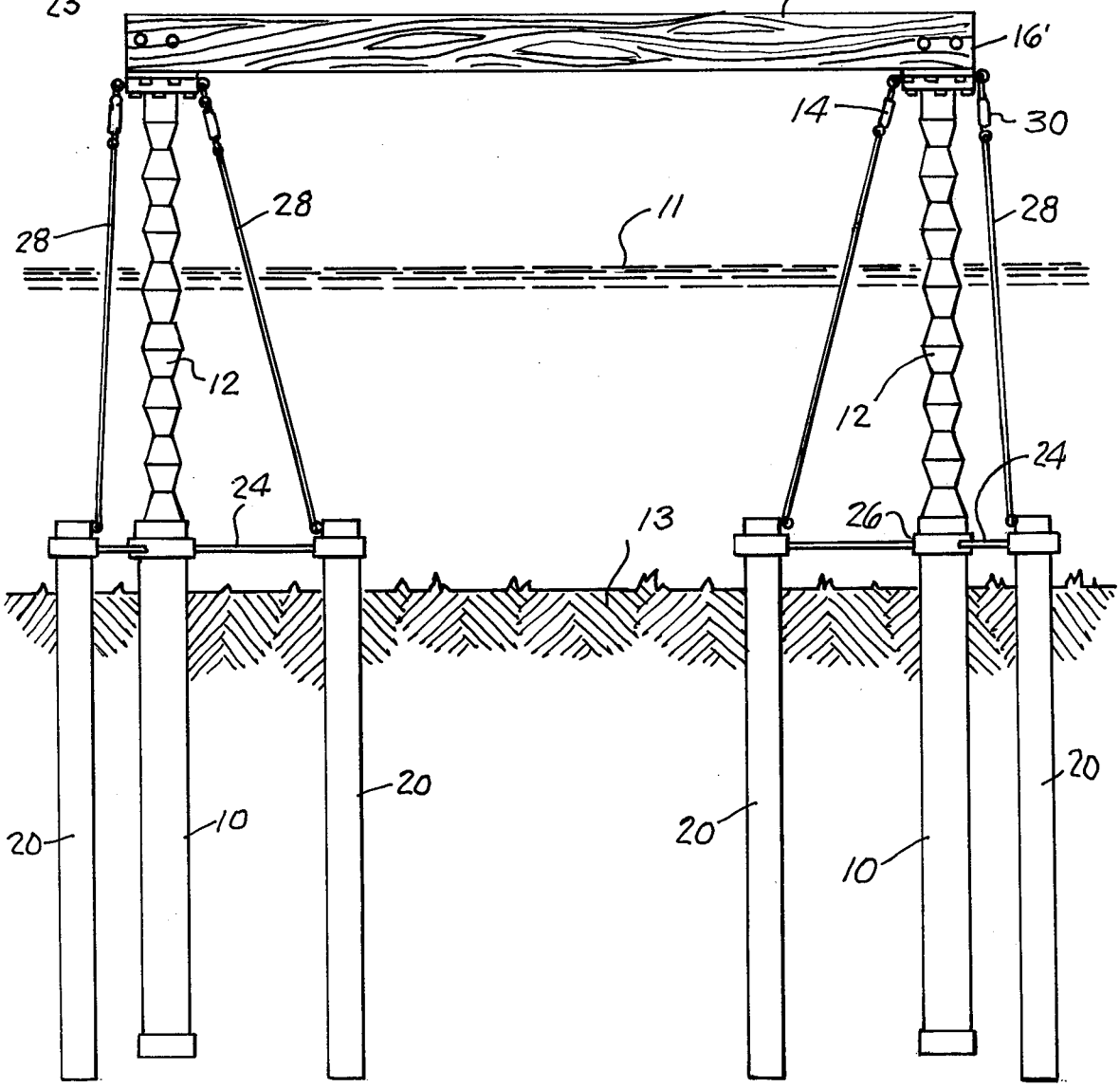
FIG. 5 is a side elevation of the boat lift of FIG. 4.

FIGS. 4 and 5 illustrate a very similar boat lift but one which employs a pair of lift cylinders 10 instead of a single cylinder. The two lift cylinders 10 are sunk in the mud bottom 13 of the body of water 11 in alignment with each other and spaced apart so as to support an elongated cradle suitable to hold a larger boat. Each lift cylinder 10 is stabilized by a similar tripod structure including the three poles 20, the rigid, radial connecting rods 24, and the chains 28 as described for the preceding embodiment. Each cradle bottom plate 16′, secured to the top of the ram, is however of rectangular shape and is disposed transversely to a line between the two lift cylinders 10. The cradle is completed by a pair of upstanding rails 18′ connected to the pair of bottom plates 16′ so as to form a rectangular structure.

In operation, the boat to be lifted is sailed over the cradle 16′, 18′ with its keel above and parallel to a center line joining the plates 16′, 16′. When the lift cylinders are operated to elevate the cradle 16′, 18′, the boat hull will rest on the two rails 18′, 18′. Since the cradle plates 16′ are both stabilized by the strut chains 28, the elevated boat sitting on the cradle will be maintained in horizontal, elevated position even though the boat may be unbalanced on the cradle. The apparatus for controlling the elevation of the two pressure fluid cylinders at an equal rate will be described hereinafter.

Figure 6:
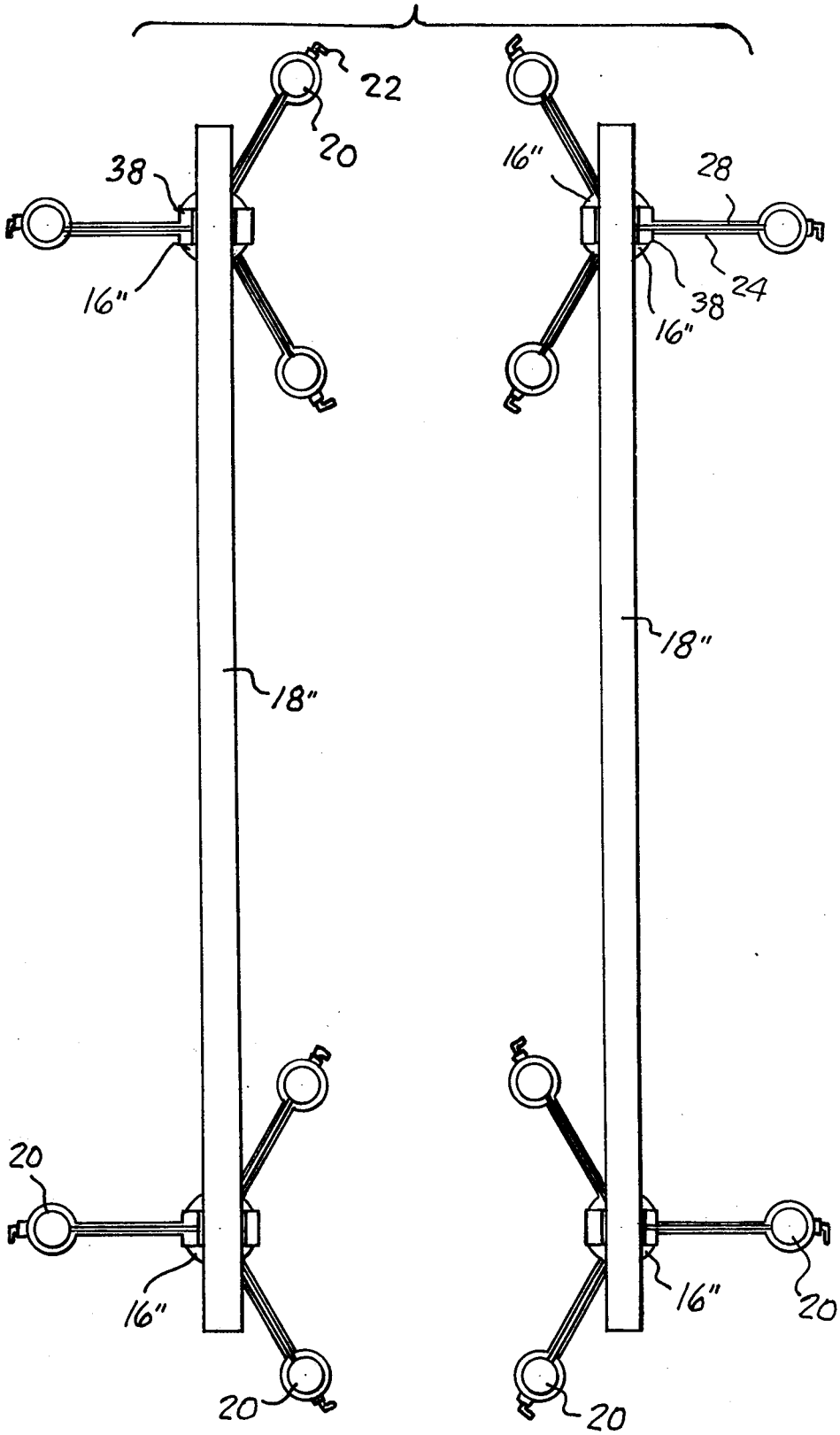
FIG. 6 is a plan view of a third embodiment of the invention employing four pressure fluid cylinders and installed under water.
Figure 7:
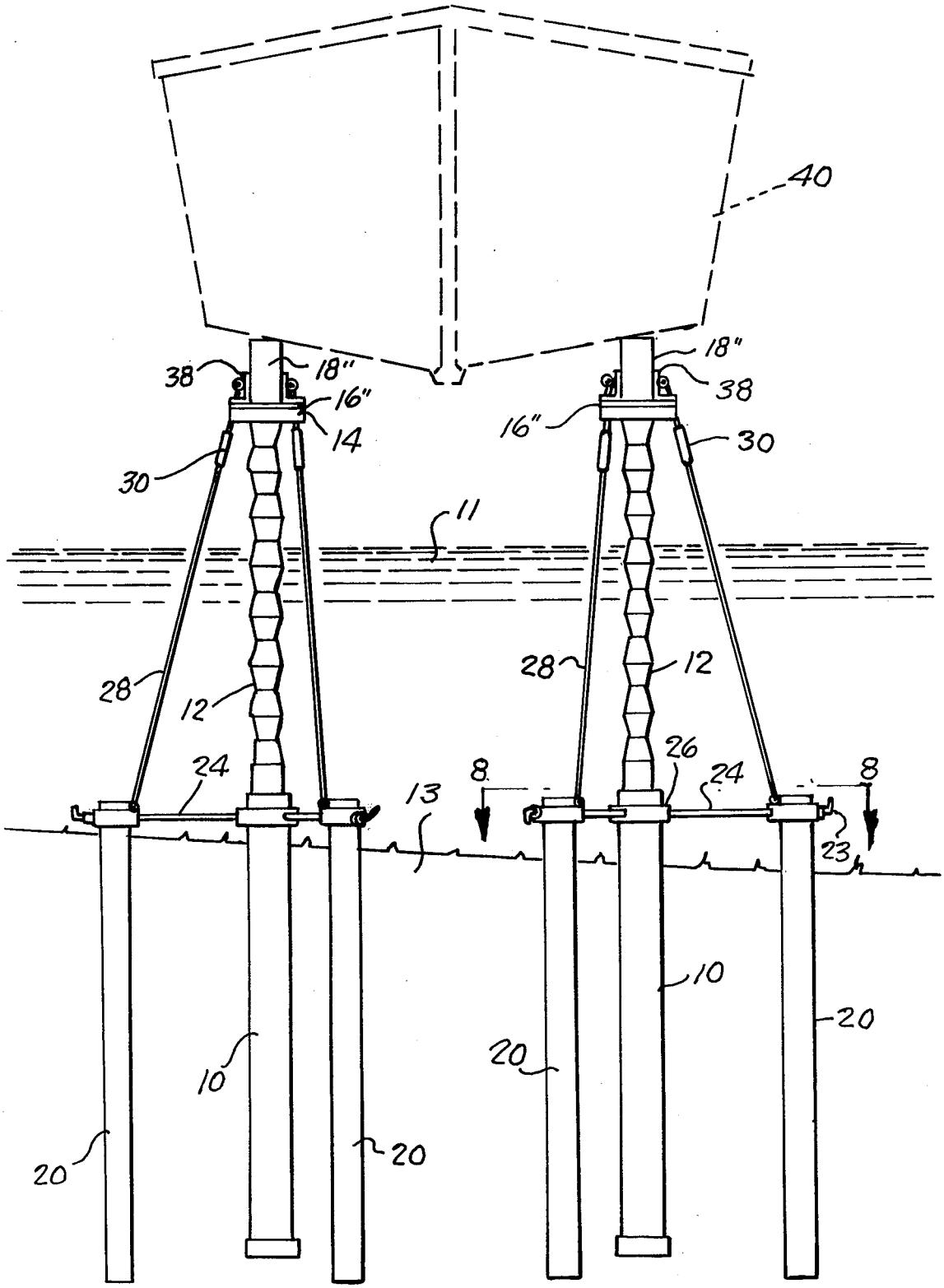
FIG. 7 is a front elevational view of the embodiment illustrated in FIG. 6.

A boat lift suitable for larger craft is illustrated in FIGS. 6 and 7 as comprising four pressure fluid lift cylinders 10 arranged at the corners of a rectangle, and each stabilized in the manner as described for the single lift cylinder of FIGS. 1–3. The cradle support plate 16'' secured to the top of each lift cylinder ram may be a disc, to which a pair of angle brackets 38 are bolted. The angle brackets are in turn bolted to the longitudinal beams 18'' which form the sides of the cradle. A boat 40 is illustrated in FIG. 7 in elevated condition on the boat lift.

Figure 8:
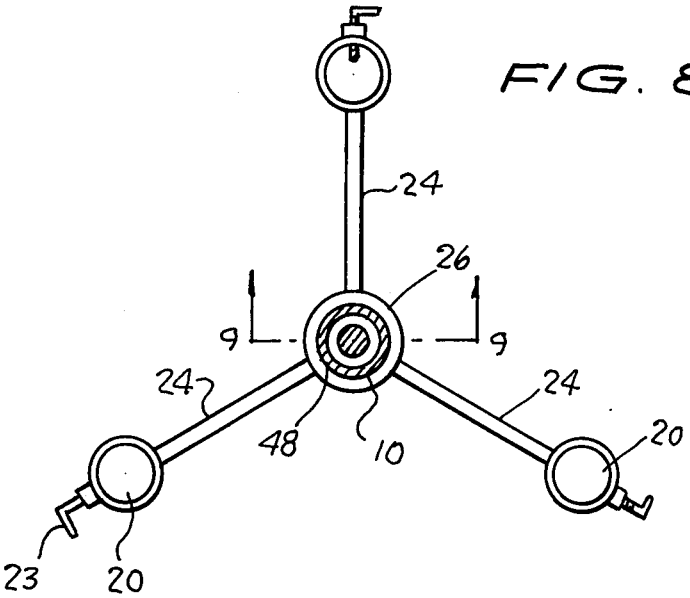
FIG. 8 is a sectional view taken along line 8—8 of FIG. 7 and looking in the direction of the arrows.
Figure 9:
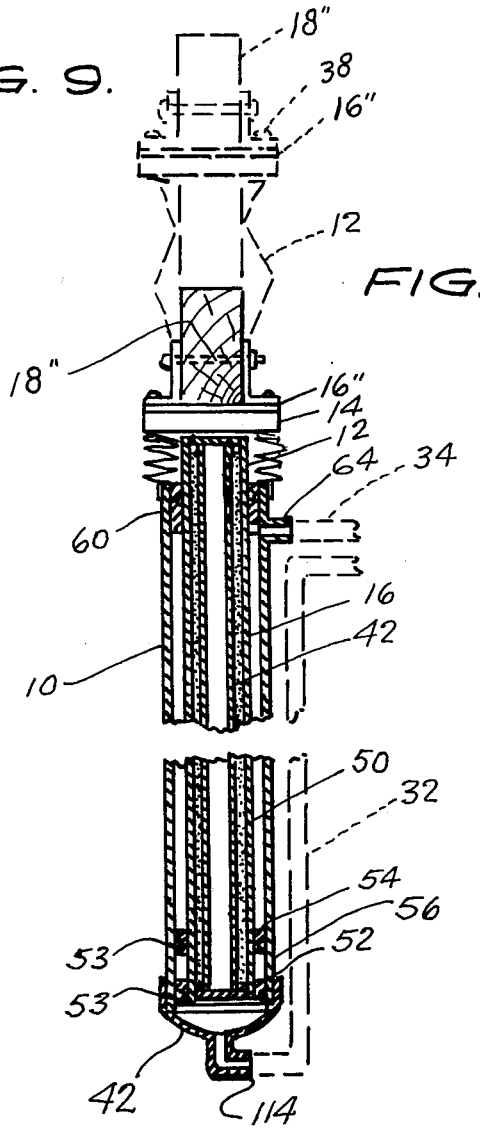
FIG. 9 is a sectional view taken along line 9—9 of FIG. 8 and looking in the direction of the arrows.
Figure 10:
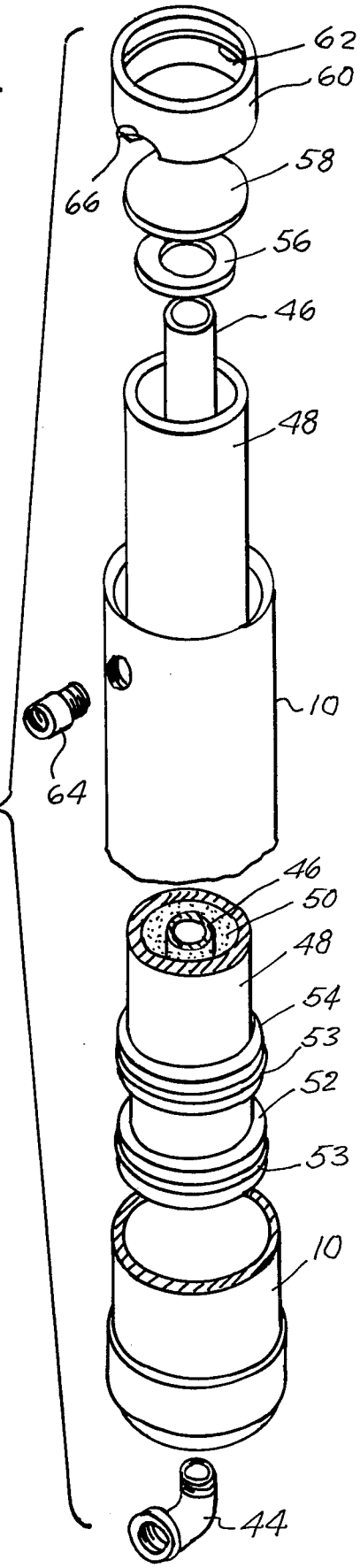
FIG. 10 is an exploded view partially in section and partially broken away illustrating the structure of one of the pressure fluid lift cylinders.

A preferred construction of each of the pressure lift cylinders 10 is illustrated in FIGS. 8, 9 and 10. Since the pressure fluid preferred to be utilized is city water from a city pressure system, nearly all of the components of the lift cylinders can be formed of non-corrosive plastic material, such as polyvinylchloride, which is available in standard forms as pipes, pipe fittings and couplings, male adapters, slip caps, tees and the like. These parts may be readily permanently secured together, where required, by thermal welding or solution welding. Thus, as described hereinafter, all parts, unless otherwise mentioned, are desirably fabricated from such standard plastic components.

The cylinder 10 is closed at its bottom by a cup-shaped slip cap 42 having a central inlet port in which is threaded an L-shaped nipple 44 for connection to the conduit 32 which leads pressure fluid to the bottom of the lift cylinder 10 for actuating the piston and ram, or push rod, thereof. The ram is comprised of a steel tube 46, coaxially disposed with a plastic outer tube 48 and the space between tubes 46 and 48 is filled with concrete 50 to yield the strength and rigidity necessary to support a heavy load. A lift cylinder piston is formed at the bottom of the ram by a pair of spaced circular plastic rings 52 and 54 each having an external circular groove in which is seated a rubber sealing O-ring 53. Pipe 46 is spaced from pipe 48 at the top and bottom by rings 56, 56 and the top of the push rod is sealed by a disc 58. The upper end of the lift cylinder 10 is spaced from the push rod outer pipe 48 by a collar 60 having an internal circular groove 62 which seats a sealing O-ring. A straight nipple 64 is threaded into an opening near the top of cylinder 10 and near the bottom of ring 60, the latter being provided with a notch 66 which seats the nipple which serves for attachment of the pressure fluid conduit 34. The flexible, folded corrugated rubber boot 12 is cemented at its bottom to the exterior of the lift cylinder 10 and is secured at its top to a support plate 14 resting on and secured to the top plate 58 of the push rod.

In operating any one of the boat lifts described above, it may be desirable if the city water pressure system is low to employ a regulating apparatus of simple nature which will boost the water pressure so that it will be suitable for lifting a boat of any desired size. An hydraulic circuit is diagrammed in FIG. 11 which illustrates one such regulating system as employing an automatic cyclic booster designated generally by the reference numeral 70, a master valve 72, a slave valve 74 and a plurality of manual control fill and drain valves.

The cyclic booster 70 comprises a cylinder 76 having a very large diameter as compared with the bores of the valves mentioned and the bore of the lift cylinder 10. A piston 78 in the booster cylinder 76 is rigidly connected by rigid piston rod 79 to a smaller diameter piston 80 which rides in a correspondingly smaller sized transfer cylinder 82.

A pressure source conduit 84 in connected through conduit 86 to ports 88 and 90 respectively located in the master and slave regulator valves 72, 74. In the position of these valves illustrated in FIG. 11, conduit 86 is connected through the slave valve 74 and its port 92 and conduit 94 to inlet port 96 in the booster cylinder 76. The outlet port 98 of the transfer cylinder 82 is connected by conduit 100 to a port 102 in the slave cylinder 74 which in the illustrated position of the slave valve is connected to another port 104 and conduit 106 to the input nipple 44 of lift cylinder 10.

The master valve 72 comprises a pair of spaced and aligned cylinders 109, 110 each having a sliding piston 112, 114 respectively. The cylinders 108, 110 are connected by a reduced cylinder 116 and the pistons 112, 114 are connected by a piston rod 118. Piston rod 118 has a plurality of enlarged lands 120, 122 and 124 which on movement of the pistons 112, 114 serve to control the opening and closing of the plurality of ports in the connecting cylinder 116. A pair of drain ports spaced from one another are shown at 126, 128 and a pair of ports 130, 132 are disposed at opposite sides of the port 88. The bottom end of cylinder 110 is connected through conduit 134 to a sensing port 136 at the right side of the booster cylinder 76 as viewed in FIG. 11. The top end of cylinder 108 is connected by conduit 138 to a sensing port 140 at the left side of the transfer cylinder 82 as viewed in FIG. 11. The ports 130 and 132 of the master valve are connected by conduits 142 and 144 to a pair of opposed cylinders 146 and 148 forming parts of the slave valve 74. The slave valve is constructed in all respects similar to the master valve and includes opposed pistons 112', 114', reduced cylinder 116', piston rod 118' and enlarged lands 120', 122', 124' and isolation land 125.

Figure 11:
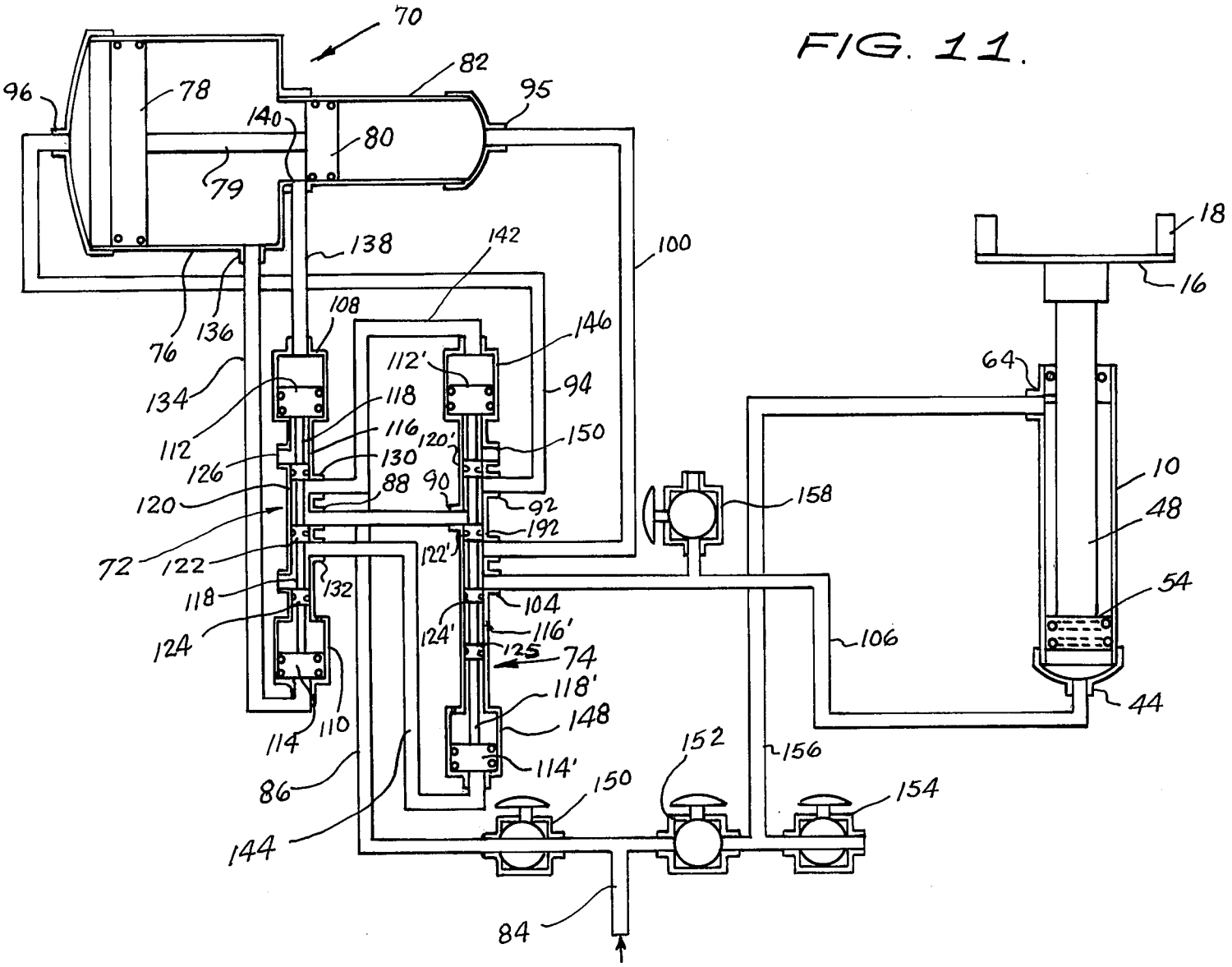
FIG. 11 is a diagram of the hydraulic circuit showing complete apparatus and connections for operation and control of a boat lift employing a single lift cylinder as for example the embodiment illustrated in FIG. 1.

The remaining elements of the hydraulic circuit of FIG. 11 comprise a plurality of manually operated, two-position valves shown as an up fill valve 150 positioned in conduit 86, a down fill valve 152 in the same conduit but on the other side of the source conduit 84, and a down drain valve 154 in the same conduit but on the other side of a conduit 156 which connects to the nipple 64 near the top of the lift cylinder 10. Still another drain valve 158 is disposed in branch conduit connected to conduit 106.

In the described hydraulic circuit, the displacement of the booster piston 78 is less than that of ram 48 and piston 54 of the lift cylinder 10. Therefore the booster must be operated through a number of cycles of charge and discharge to completely elevate the ram of the lift cylinder.

To operate the boat lift, up fill valve 150 and down drain valve 154 are opened while valves 152 and 158 remain closed, as illustrated in FIG. 11. City water, under pressure, will enter through conduit 84 and pass through conduit 86 into port 88 of the master valve 72 and port 90 of the slave valve 74, thus tending to hold the pistons 112, 114 of these valves in the positions illustrated in FIG. 11. The water under pressure will then pass through conduit 94 into the inlet port 96 of the booster cylinder 76 and the booster piston 78 will be forced toward the right, as viewed in FIG. 11. The transfer piston 80 is moved a corresponding distance in the same direction, by reason of the rigid connection between the two pistons, and pressure fluid in the transfer cylinder 82 passes through conduit 100 ports 102 and 104 of the slave valve, conduit 106 into the inlet nipple 44 at the bottom of the lift cylinder 10, so that a proportionate amount of lift is imparted to the lift cylinder piston 44.

Upon nearing completion of filling of the booster cylinder with liquid, the booster piston 78 uncovers the sensing port 136. At this time incoming pressure fluid from cylinder 76 passes through conduit 134 and lifts the piston 114 and connected piston 112 to the limit of their displacements. The lands 120, 122 and 124 in the master valve will have moved to connect port 88 to port 132 and port 130 to drain port 126. Thus incoming pressure water will be diverted from conduit 86 into conduit 144 and exert pressure on the bottom of slave piston 114' to lift this piston to its upper position in the cylinder 148. When the two slave pistons 114', 112' are in their uppermost positions, the lands of the slave cylinder will have moved to connect port 90 to port 102 causing the incoming pressure fluid to be diverted into conduit 100 so as to exert pressure at the right side of transfer piston 80. At the same time conduit 94 will be connected through port 92 to drain port 150 permitting the booster cylinder 76 to drain while the transfer piston 80 and booster piston 78 move to the left until they return to their initial positions as shown in FIG. 11. While this is occurring, pressure fluid in cylinder 82 is forced into conduit 138 where it exerts pressure on the top of master valve piston 112 causing that piston to start to move downwardly toward its lowermost position. In the meantime the slave valve pistons 112' 114' being in their uppermost position, the bottom land 124' of the slave valve blocks any connection between port 104 and port 102 so that the pressure fluid in conduit 106 and in the bottom part of the lift cylinder 10 is locked there while the booster piston 78 is moving from the right to the left.

When the master valve pistons have moved down to their lowermost positions as illustrated in FIG. 11, ports 88 and 130 are reconnected so that incoming pressure fluid flows through conduit 86, port 88, port 130, conduit 142 to the top of slave cylinder 146 causing the piston therein to move down from its upper position to its lower position as illustrated in FIG. 11. Thus both the master valve and the slave valve are repositioned to their original conditions and the incoming city water is again allowed into the left side of the booster cylinder 76 to start the next charge-discharge cycle. The cycle described above is repeated for the number of times necessary to completely elevate the boat lift cradle 16, 18.

When the lift is fully elevated the operator may close all of the valves 150, 152, 154 and 158 which places the control apparatus in its storage mode. The back pressure from lift cylinder 10 presses upwardly on the lands of the slave valve and elevates the pistons of the slave valve to their upper positions. This closes passage between ports 104 and 102 and locks the pressure fluid in conduit 106 and in the lift cylinder 10. Upward movement of the slave valve pistons in turn will cause the master valve to elevate to its upper condition, while drain water within the master valve is removed by such movement to drain through the ports 126 and 128.

With the apparatus in storage mode the boat cradle may be lowered evenly even though the boat on the cradle 16, 18 is unbalanced thereon, by opening valves 152 and 158. The weight of the boat will then force the ram 48 and piston 54 downwardly in cylinder 10 forcing the pressure water in the bottom of the cylinder through conduit 106 and drain valve 158. At the same time, city water under pressure is admitted through conduit 84, valve 152, and conduit 156 into port 64 at the top of the lift cylinder 10 to assist with its force the weight of the boat in lowering the cradle.

Figure 12A:
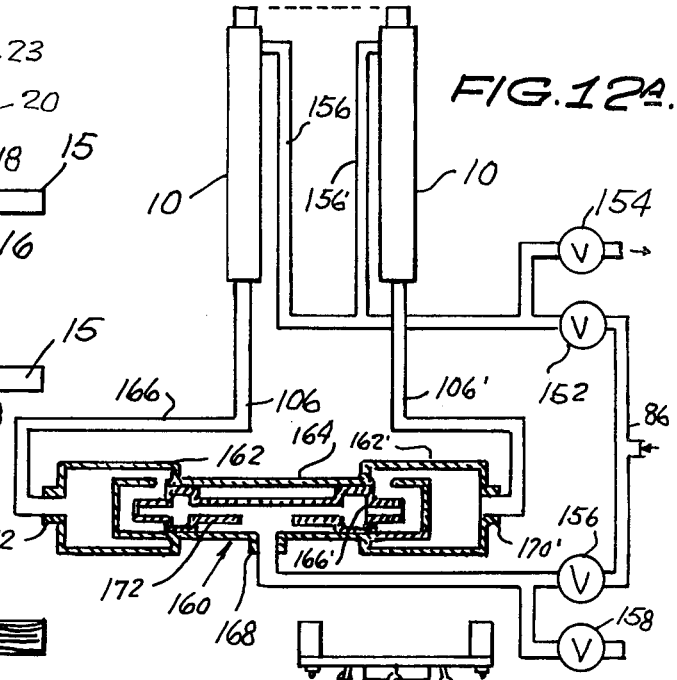
FIG. 12A is an hydraulic circuit diagram similar to that of FIG. 12 but of a simplified system omitting booster and transfer cylinders as well as master and slave valves and substituting a flow equalizer valve.
Figure 12:
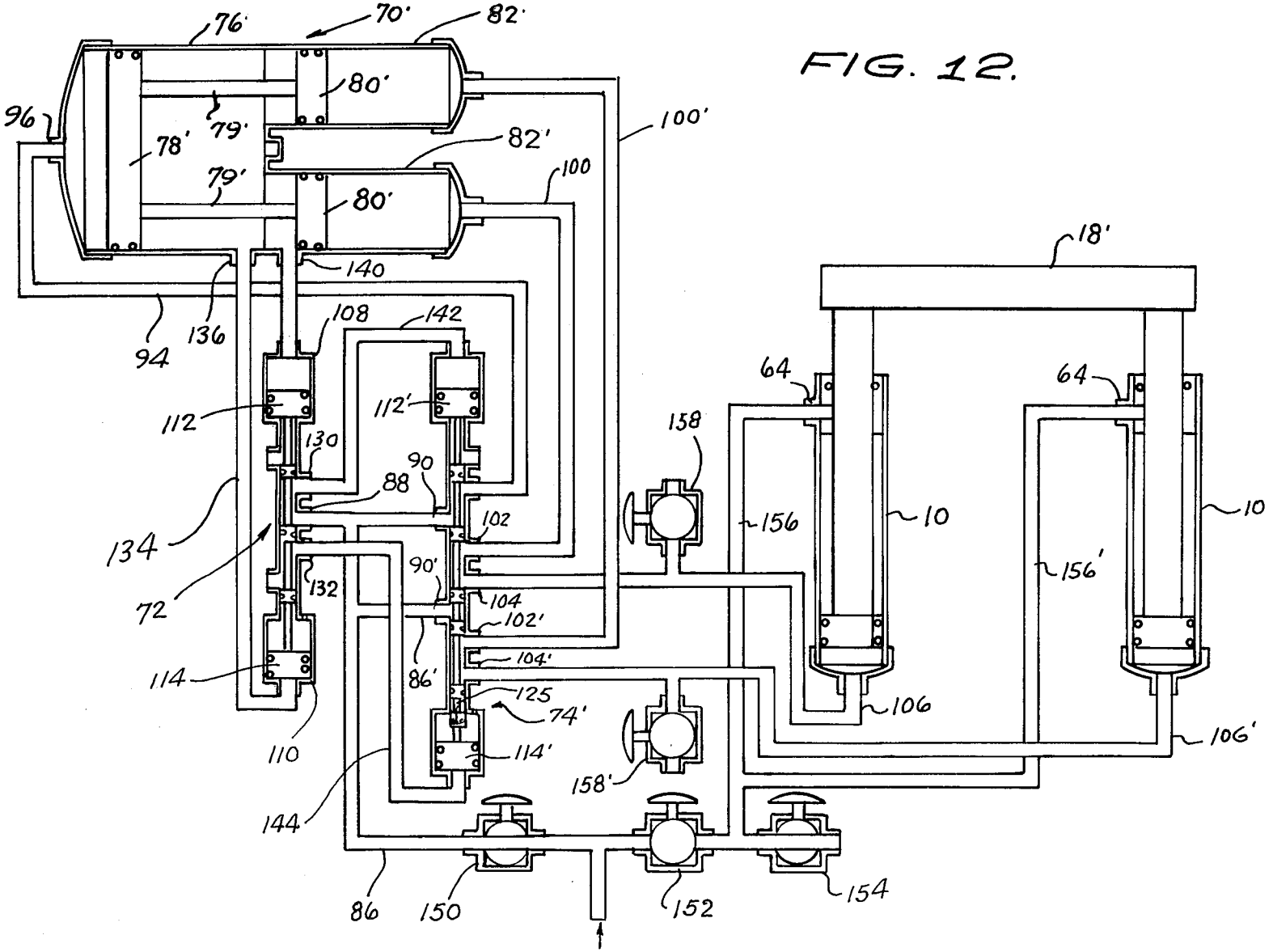
FIG. 12 is a diagram similar to FIG. 11 but showing the hydraulic circuit of a complete system for operation and control of a boat lift utilizing a pair of lift cylinders, as for example the embodiment illustrated in FIGS. 4 and 5.
Figure 14:
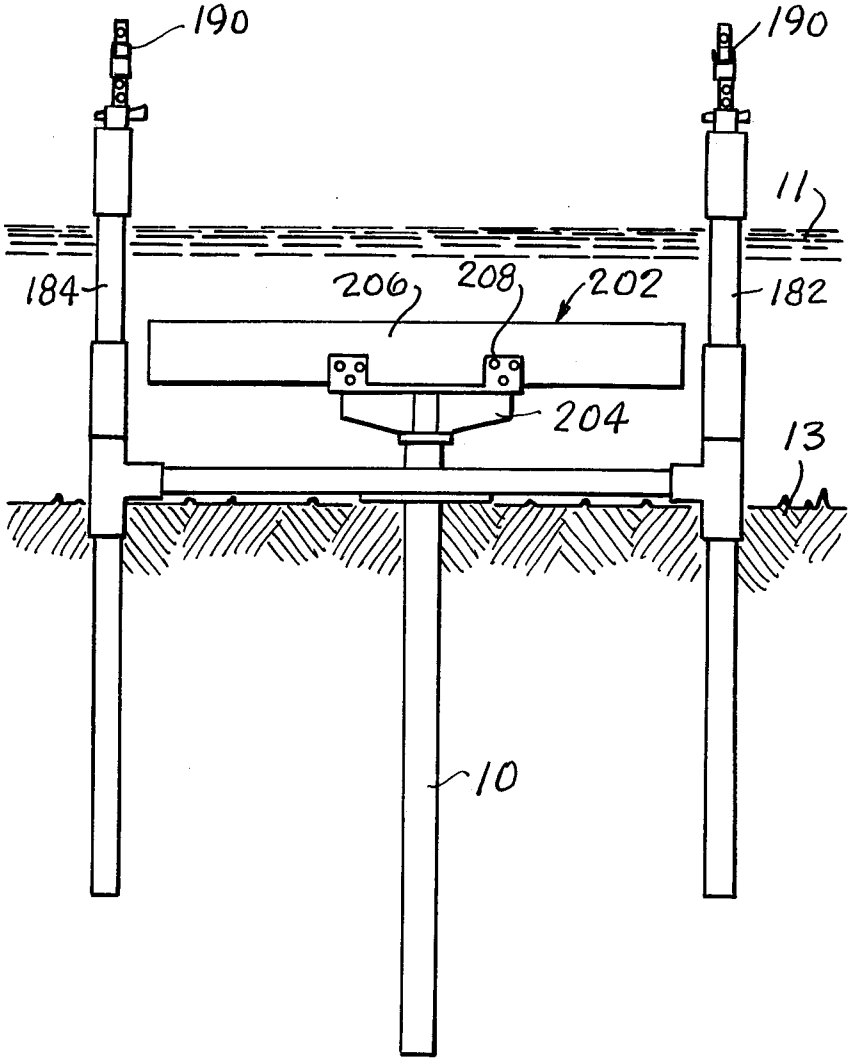
FIG. 14 is also a front elevation of the embodiment of FIG. 13 but with the boat omitted and the boat cradle turned 90°.

FIG. 12 illustrates a similar hydraulic circuit usable with a dual cylinder boat lift in which the circuit is identical with that of FIG. 11 except for the few changes described below. A cyclic booster 70' is utilized which incorporates the single booster cylinder 76' with its piston 78' and a pair of transfer cylinders 82', 82'. The pistons 80', 80' of the transfer cylinders are ridigly connected to the booster piston 78' by a pair of rods 79', 79'. The second transfer cylinder is connected by a conduit 100' to the slave cylinder 74' and from the slave cylinder serves to conduct pressure fluid through conduit 106' to the bottom of the second lift cylinder 10 at the right side of the FIG. 12 illustration. The master valve 72 remains unchanged, but the slave valve 74' is constructed like slave valve 74 except that it is lengthened and additional ports are added. For example, an additional port 90' is added for conduit 86' which branches from conduit 86. A pair of additional ports 102' and 104' are added, port 102' connecting to conduit 100' which connects to the second transfer cylinder 82', while port 104' connects conduit 106' which admits pressure fluid to the bottom of the second lift cylinder 10. An additional drain valve 158' is connected to conduit 106'.

The dual cylinder boat lift illustrated in FIG. 12 operates exactly in the same manner as explained above for a single boat lift illustrated in FIG. 11, and no further description thereof is deemed to be necessary.

Where the pressure of a city water system is adequate for operating a boat lift, a simpler hydraulic circuit omitting the booster and transfer cyliners, and the master and slave valves, may be utilized as illustrated in FIG. 12A. A pair of lift cylinders 10, 10 are connected to incoming city water conduit 86 at their upper ends by conduits 156, 156', and at their lower ends by conduits 106 and 160' through a flow equalizer valve 160 which is automatically operable to equalize flow of pressure fluid even though the boat lift is unevenly loaded. The mentioned conduits are provided with a down drain valve 154, a down fill valve 152, an up fill valve 150, and an up drain valve 158 as shown at the right-hand side of FIG. 12A.

The flow equalizer valve 160 comprises a pair of spaced cylindrical end portions 162, 162' connected by a cylindrical central portion 164 of smaller diameter. The central portion 164 extends into the two end portions 162, 162' and connecting orifices therebetween are provided at 166 and 166'. A central port 168 is provided in the portion 164 for connection to the conduit 86. Ports are provided at 170, 170' in the enlarged portions 162, 162' for connection to the conduits 106, 106'. Within the cylindrical body 162, 164, 162' is positioned a similarly formed hollow, cylindrical body 172 which has a central opening for the passage of pressure fluid into its interior and a pair of openings at the ends of its pair of enlarged portions. The enlarged portions have a diameter slightly less than the internal diameter of the central portion 164 of the outer body so that the internal body 172 is capable of sliding from side to side dependent upon the pressure fluid flowing through the device. The internal body 172 is therefore what may be considered to be an automatically operable shuttle valve which shuttles from side to side within the outer body 160.

When it is desired to operate the dual cylinders 10, 10 to lift a boat supported on their rams, the up fill valve 150 and the down drain valve 154 would be manually opened. This permits pressure fluid in the form of city water under its normal pressure to enter conduit 86 and into the flow equalizer valve 160 through port 168. This water would then divide equally and flow through the interior of the shuttle valve 172 and out the ends thereof, thence through equally opened passages 166, 166' through conduits 106, 106' into the cylinders 10, 10, so as to raise the pistons therein and the boats supported thereon equally. Should the boat be unequally loaded on the two lift cylinders, say with more weight on the left cylinder than on the right cylinder as viewed in FIG. 12A, greater back pressure would exist in conduit 106 than in conduit 106' and this would cause the shuttle valve 172 to move toward the right to partially close the port 166'. As a result more pressure fluid would flow into conduit 106 through port 166 than into conduit 106' through port 166', so that the pistons of both cylinders 10 would nevertheless elevate at the same rate. Obviously, if the boat were unevenly balanced with more weight on the right cylinder 10 than on the left cylinder 10, the shuttle valve 172 would move toward the left as viewed in FIG. 12A, opening port 166' and tending to close port 166 so that more incoming pressure fluid would be admitted to the right lift cylinder 10 than to the left lift cylinder 10.

When it is desired to lower a boat cradled on the boat lift of FIG. 12A in its raised position, the operator would open up the drain 158 and close the other three valves 150, 152, 154. Thus the source of incoming pressure fluid would be shut off at valve 150 and pressure fluid in the system would be free to drain through valve 158. The weight of the boat on the lift would thereupon tend to lower both pistons of lift cylinders 10, 10, forcing pressure fluid downwardly in conduits 106, 106' into the ends of equalizer valve 106 and out of port 168. As long as the boat is equally balanced on the two cylinders 10, 10, the pressures at opposite ends of shuttle valve 172 will be equal and the two orifices at 166, 166' will be equally opened so that the pistons in both lift cylinders will descend at an equal rate carrying the boat downwardly. If, however, the boat is unevenly balanced on the two lift cylinders 10, 10, so that more weight is on the left cylinder as viewed in FIG. 12A, the shuttle valve 172 would be subjected to higher pressure at its left hand than its right hand tending to move the shuttle valve toward the right and tending to close the orifice 166'. As a result, water would flow out of the left lift cylinder 10 and through the left side of the equalizer 160 to the drain valve 158 at a faster rate than water would flow from the right cylinder 10 through the right side of the equalizer 160. Thus the flow equalizer 160 tends to lower any boat supported on the two lift cylinders in an even manner even though unequally balanced on the cylinders. It should be apparent that a flow equalizer of the type described is useful with boat lifts comprising even more than two cylinders. For example, if four cylinders were used, three flow equalizers would be needed, one to balance each pair of cylinders and one to balance the pair of flow equalizers needed for the two pairs of cylinders.

In FIGS. 13 to 16 is illustrated a simplified embodiment of the boat lift utilizing a fixed docking frame in and extending above the water and a single lift cylinder. This embodiment involves the novel method of sailing a boat between support posts of the docking frame, lifting the boat above the level of the posts, turning the boat 90°, and lowering the boat onto the posts.

Figure 16:
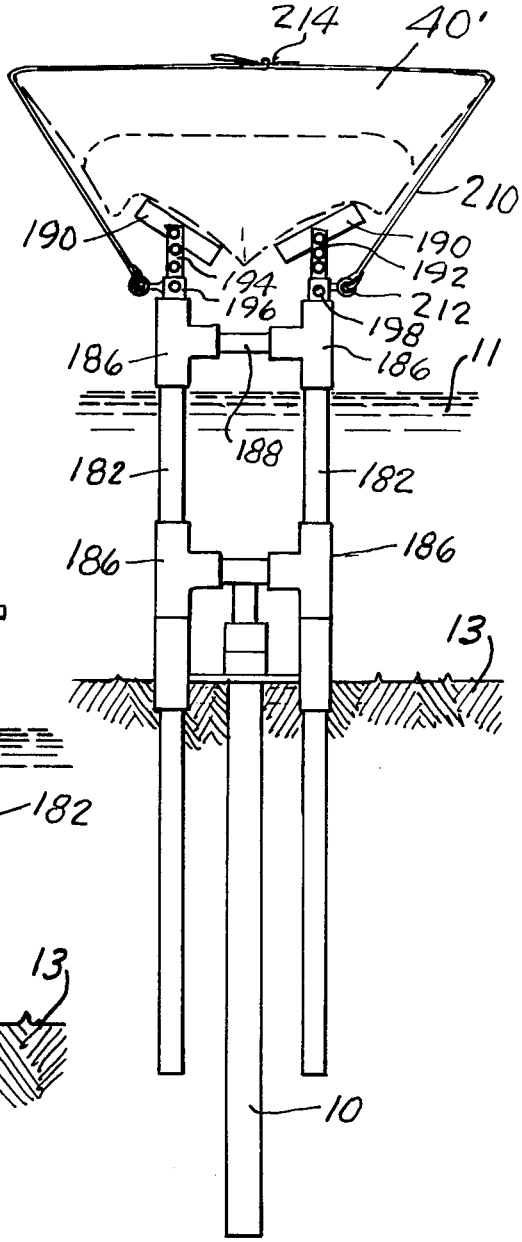
FIG. 16 is a side elevation of the boat docking frame with the boat lowered to rest thereon and strapped down.

The docking frame 180 is fixed in the water 11 and comprises a pair of vertical posts 182, 182, FIG. 16, having their lower ends buried in the water bed 13 and their upper ends above the water level, and a second pair of similarly constructed and mounted posts 184, 184. The posts 182, 182 are spaced rather closely together, a distance less than the width of the boat to be docked, and are joined by four T-shaped pipe couplings 186 connecting upper and lower bracing bars 188, 188. Each pair of posts carries a pair of boat supporting chocks 190, 190 each of which is vertically adjustable by support rod 192 having vertically spaced openings 194, and telescopically slideable in a tube 196 having an aperture for passage of an adjustment locking pin 198. The chocks 190 of each pair are preferably inclined downwardly and inwardly toward one another and bear a corrugated rubber, or other, soft, high friction surface material to seat the boat. Each post 182 is joined to a post 184, FIG. 13, by a pair of T-shaped pipe couplings 186, 186 and a bracing bar 200. The pairs of posts 182, 182 and 184, 184 are spaced sufficiently far apart to permit a boat 40' to be sailed to a stop between them, but the posts of each pair are relatively close, less than the boar width, so as to support the boat after it is turned. The cylinder 10 may be constructed as illustrated in FIGS. 9 and 10 but omitting the corrugated protective boot, and other minor parts, so that the internal piston and upstanding rod, or ram, are free to turn about the axis of the cylinder. The cylinder may be operated by a conventional hydraulic circuit or by the booster regulating circuit such as disclosed in FIG. 11. Fixed to the upper end of the cylinder ram 46–48 is a cradle 202 comprising a base member 204 and a pair of elongated, vertical side boards 206, 206 supported on the base by U-shaped bracket 208. When the boat has been deposited on the docking frame as shown in FIG. 16, it may be securely tied down by a flexible strap 210 having its ends secured in loops 212 fixed to the support tubes 196, 196. The intermediate portions of strap 210 may be fastened by a buckle 214.

Figure 13:
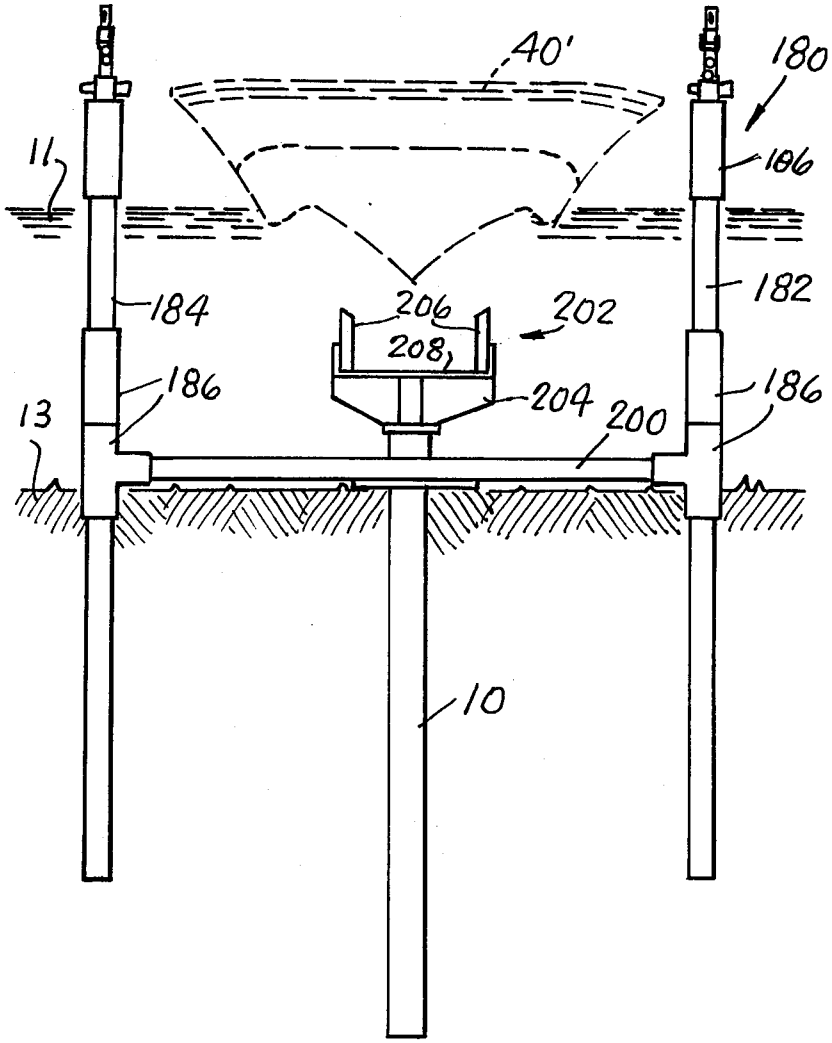
FIG. 13 is a front elevation of a fourth embodiment of the invention utilizing a fixed docking frame and a single lift cylinder with a boat shown in position for lifting.
Figure 15:
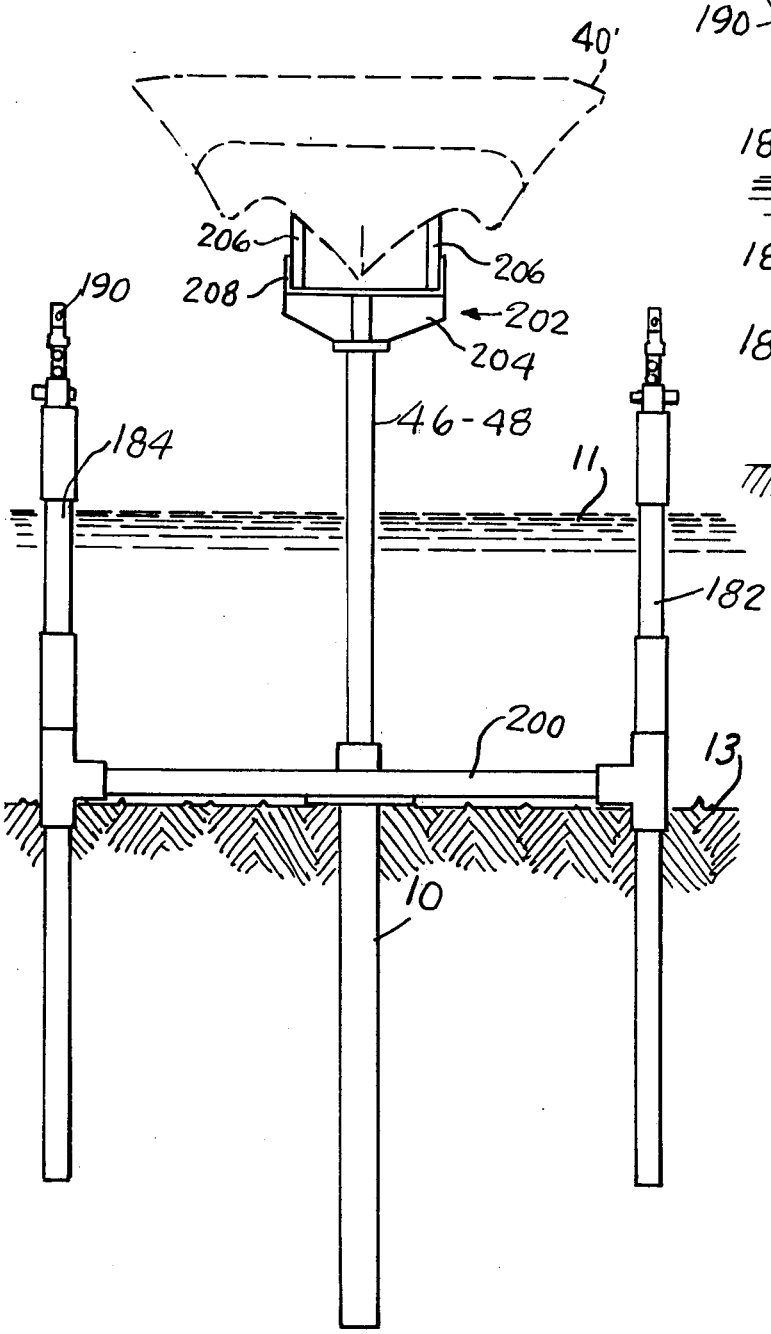
FIG. 15 is a front elevation similar to FIG. 13 but with the boat lifted to a level above the docking frame.

In operation of the FIG. 13 to 16 embodiment, the boat 40 is sailed to a stop between docking frame posts 182, 184 and over the centrally disposed cylinder 10 carrying cradle 202, as shown in FIG. 13. The cylinder is then fed pressure fluid to elevate the cradle 202 into engagement with the hull bottom, and to lift the boat to a level above the docking frame posts, as shown in FIG. 15. The boat is then turned 90° by hand (or otherwise) of a person standing on shore or on a dock, not shown, and using a boat hook to exercise turning force. The boat, the cradle 202, and the ram and piston in cylinder 10, turn together with respect to the cylinder and this places the boat hull directly over the chocks 190, 190 instead of between them. The cylinder is then operated to lower its ram carrying the cradle and boat until the boat hull seats on the chocks. The boat may then be tied securely by strap 210 in its position on the docking frame above the water level. The ram and cradle then preferably are lowered to their positions of FIG. 14 to protect the ram from marine growth. When it is desired to remove the boat from the docking frame and refloat it in the water, it is merely necessary to repeat the preceding steps in reverse sequence.

Although certain specific embodiments of the invention have been shown and described, it is obvious that many modifications thereof are possible. The invention, therefore, it not intended to be restricted to the exact showing of the drawings and description thereof, but is considered to include reasonable and obvious equivalents.

What is claimed is:

1. A boat lift and combined dry docking frame, comprising a generally vertical, pressure fluid lift cylinder having its lower end buried in the bed of a body of water, a piston in said cylinder and a ram secured to the piston and extending through the upper end of the cylinder, a boat cradle secured to the upper end of said ram, said cradle, ram and piston being rotatable together with respect to said cylinder, and a docking frame fixedly mounted in said body of water, said docking frame comprising first and second pairs of closely spaced vertical boat support posts having their lower ends buried in the bed of said body of water, their upper ends above the water level and their intermediate portions joined by bracing bars, the second pair of posts being positioned on the opposite side of the boat cradle from the first pair at a sufficient distance to permit a boat to be sailed over the cradle, and sufficiently close to seat and hold the boat when turned 90°, additional bracing bars joining the posts of one pair to those of the second pair, and vertically adjustable boat seating chocks mounted on the upper end of said posts, whereby when the cylinder is operated to lift a boat on the cradle above the support posts, the boat may then be turned 90° and lowered onto the posts.

2. A boat lift according to claim 1 wherein said cylinder, its piston and ram are formed from non-corrosive plastic material, said piston and cylinder including O-ring seals formed of a rubber material.

3. A boat lift according to claim 1 wherein said lift cylinder comprises an outer cylinder open at the top and closed at the bottom, an inlet port in the bottom closure, a discharge port near the top of the cylinder, said piston comprising an inner cylinder closed at the bottom, having axially spaced rings secured near its bottom each having a circumferential groove seating an O-ring seal for sliding engagement with the outer cylinder, said inner and outer cylinders being formed of plastic, said ram comprising a steel tube coaxially positioned in said inner cylinder and concrete filled in the space between said tube and inner cylinder.

4. A boat lift and docking frame according to claim 1, wherein is additionally provided a flexible boat tie secured near its ends to one of the posts of said first and second pairs and capable of passing over a boat seated on the support posts to hold the boat securely thereon.

5. A boat lift and combined dry docking frame as set forth in claim 1, wherein said boat seating chocks are pivotally mounted on vertically adjustable supports, whereby to accomodate the chocks to the sloping hull sides of a boat.

6. A boat lift and dry dock intended for lifting and docking a boat having a greater length than width, comprising a generally vertical, pressure fluid cylinder having its lower end buried in the bed of a body of water, a ram in said cylinder extending through the upper end of the cylinder, an elongated boat cradle for seating the underside of the boat longitudinally thereon, said cradle and ram being rotatable together with respect to said cylinder, and a dry dock fixedly mounted in said body of water transversely of said cradle, said dry dock comprising at least one pair of support post means having their lower ends buried in the bed of said body of water and their upper ends above the water level, the support post means of said pair being spaced apart transversely of said cradle a distance sufficient to accommodate the width of said boat but less than the length of said boat, whereby the boat may be sailed between the support post means, lifted by the cradle above the water and the upper ends of the support post means, turned 90° and lowered by the cradle onto the support post means.

7. A boat lift and dry dock as set forth in claim 6, wherein is provided a source of supply of pressure fluid for said cylinder comprising a community water system.

8. A combination boat lift and dry dock comprising:

(1) dry dock means, for a boat having greater length then width, including at least a pair of hull supports spaced transversely of the boat a distance greater than the boat width and extending above the level of the water in which the boat floats;

(2) cradle means for seating the boat longitudinally, said means being disposed under the water level and between said pair of hull supports;

(3) means for lifting a boat seated on said cradle means to a level above said hull supports of the dry dock means;

(4) means for turning said cradle means with a boat seated thereon 90° so that the boat hull lies above said hull supports; and (5) means for lowering said cradle means and boat seated thereon to rest the boat on said hull supports.

9. The method of dry docking a boat comprising the steps of:

(1) sailing a boat to a position between support posts of a fixed docking frame having upper ends disposed above the water level;

(2) lifting the boat to a level above the upper ends of said support posts;

(3) turning the boat 90° so that its bottom overlies said support posts; and (4) lowering the boat to rest on the posts.

10. The method of dry docking a boat according to claim 9, wherein said lifting of the boat, step (2), is performed by an hydraulic cylinder.

11. The method of dry docking a boat according to claim 10, wherein said step of turning the boat 90° is accomplished by turning force applied to the boat while supported by the ram of said cylinder, said ram turning freely with respect to the cylinder.

12. The method of dry docking a boat according to claim 10, wherein a community water system is utilized as a source of su$_r$ply of pressure fluid to said hydraulic cylinder.

13. The method of dry docking a boat according to claim 9, wherein said lowering of the boat to rest on the posts, step (4) is followed by the step of tying the boat down to the posts.

* * * * *